US010471480B2

(12) United States Patent
Chang

(10) Patent No.: US 10,471,480 B2
(45) Date of Patent: Nov. 12, 2019

(54) DETERGENT DISPENSING DEVICE

(71) Applicant: Guangzhou Faner Aroma Product Co., Ltd., Guangzhou (CN)

(72) Inventor: Hsu-Hui Chang, Guangzhou (CN)

(73) Assignee: GUANGZHOU FANER AROMA PRODUCT CO., LTD., Guangzhou, Guangdong (CN)

( * ) Notice: Subject to any disclaimer, the term of this patent is extended or adjusted under 35 U.S.C. 154(b) by 222 days.

(21) Appl. No.: 15/654,667

(22) Filed: Jul. 19, 2017

(65) Prior Publication Data

US 2019/0022711 A1 Jan. 24, 2019

(51) Int. Cl.

| | |
|---|---|
| ***B08B 3/04*** | (2006.01) |
| ***A47L 15/44*** | (2006.01) |
| ***D06F 39/08*** | (2006.01) |
| ***A47K 5/12*** | (2006.01) |
| ***B05B 11/00*** | (2006.01) |
| *D06F 39/02* | (2006.01) |

(52) U.S. Cl.

CPC ..... *B08B 3/047* (2013.01); *A47K 5/1207* (2013.01); *A47L 15/4436* (2013.01); *B05B 11/0059* (2013.01); *B05B 11/3001* (2013.01); *D06F 39/088* (2013.01); *A47L 15/4445* (2013.01); *D06F 39/024* (2013.01)

(58) Field of Classification Search

CPC ..... B08B 3/047

See application file for complete search history.

(56) References Cited

U.S. PATENT DOCUMENTS

| | | | | |
|---|---|---|---|---|
| 2006/0151544 | A1* | 7/2006 | Greenwald | B67D 1/0079 222/333 |
| 2008/0173705 | A1* | 7/2008 | Girard | A47J 31/402 235/375 |
| 2008/0203114 | A1* | 8/2008 | LaFlamme | B05B 11/0072 222/207 |
| 2009/0071977 | A1* | 3/2009 | Abe | A47K 5/1204 222/105 |
| 2011/0139827 | A1* | 6/2011 | Greenwald | B67D 1/0079 222/333 |

* cited by examiner

*Primary Examiner* — Jason Y Ko

(74) *Attorney, Agent, or Firm* — Leong C. Lei

(57) ABSTRACT

The detergent dispensing device includes a base and an extrusion assembly. The extrusion assembly is joined to the base, and includes a seat member having a first tube and a second tube extending upward and forward, respectively. A volume control member is configured inside the first tube and a resilient engagement member is reciprocally moveable along the second tube. The extrusion assembly also includes a connection member connecting the first tube. A detergent bottle is fit on the connection member and the detergent flows into the first tube through the connection member. When the engagement member is engaged, a first ball of the volume control member allows the detergent to flow out of the first tube. As the engagement member is restored resiliently, the first ball blocks the first tube, thereby providing a fixed amount of detergent.

7 Claims, 10 Drawing Sheets

DETERGENT DISPENSING DEVICE

BACKGROUND OF THE INVENTION

(a) Technical Field of the Invention

The present invention generally relates to detergent dispensing devices and, more particularly, to a detergent dispensing device providing a fixed amount of detergent for each dispense with secured detergent provision.

(b) Description of the Prior Art

For a conventional provision device for liquid soap or detergent, taking R.O.C Utility Model Patent No. 535562, titled "Device for supplying cleaning liquid" as example, mainly includes a main member with an opening. The main member has a first case and a second case hinged to the first case. The first and second cases jointly define a storage space connected to the opening. An elastic arm on the second case is extended into the storage space. A storage element is disposed inside the storage space for storing detergent. A provisioning element is configured inside the storage space and has a flexible pipe connecting the storage element. A nozzle is connected to the flexible pipe and extended into the opening. The second case may be engaged to move between a first position and a second position relative to the first case. When at the first position, the elastic am is away from the first case whereas, when at the second position, the elastic arm is adjacent to the first case and pressurize the flexible pipe so that detergent inside the flexible pipe is squeezed out of the nozzle and the opening.

However, the conventional provision devices require a specific storage element (bottle) for detergent. Therefore a user has to store the detergent in the specific storage element and mount the storage element on the provision device, which is quite troublesome. In addition, to use a different detergent, the current detergent in the storage element has to be removed first before filling in the different detergent, causing significant inconvenience.

SUMMARY OF THE INVENTION

Therefore the present invention provides a novel detergent dispensing device, which includes a base and an extrusion assembly. The base is for attaching the detergent dispensing device to a surface such as a wall. A front side of the base is configured with a pair of opposing first fastening elements. The extrusion assembly is joined to the front side of the base, and includes a seat member having a pair of fourth fastening elements for joining to the first fastening elements of the base so that the extrusion assembly is integrated to the base. The seat member also includes a first tube and a second tube extending upward and forward, respectively. A volume control member is configured inside the first tube and a resilient engagement member is reciprocally moveable along the second tube. The extrusion assembly also includes a connection member connecting the first tube.

The gist of the present invention lies in that various types of detergent bottles may be fit on the connection member. The detergent flows into the first tube through the connection member. When the engagement member is engaged, a first ball of the volume control member allows the detergent to flow out of the first tube. As the engagement member is restored resiliently, the first ball blocks the first tube, thereby providing a fixed amount of detergent. Therefore the detergent dispensing device may be applied to all kinds of detergent bottles. There is no need to store the detergent into a specific type of storage bottle in advance, thereby enhancing the convenience of the detergent dispensing device.

The foregoing objectives and summary provide only a brief introduction to the present invention. To fully appreciate these and other objects of the present invention as well as the invention itself, all of which will become apparent to those skilled in the art, the following detailed description of the invention and the claims should be read in conjunction with the accompanying drawings. Throughout the specification and drawings, identical reference numerals refer to identical or similar parts.

Many other advantages and features of the present invention will become manifest to those versed in the art upon making reference to the detailed description and the accompanying sheets of drawings in which a preferred structural embodiment incorporating the principles of the present invention is shown by way of illustrative example.

DETAILED DESCRIPTION OF THE PREFERRED EMBODIMENTS

Figure 1:
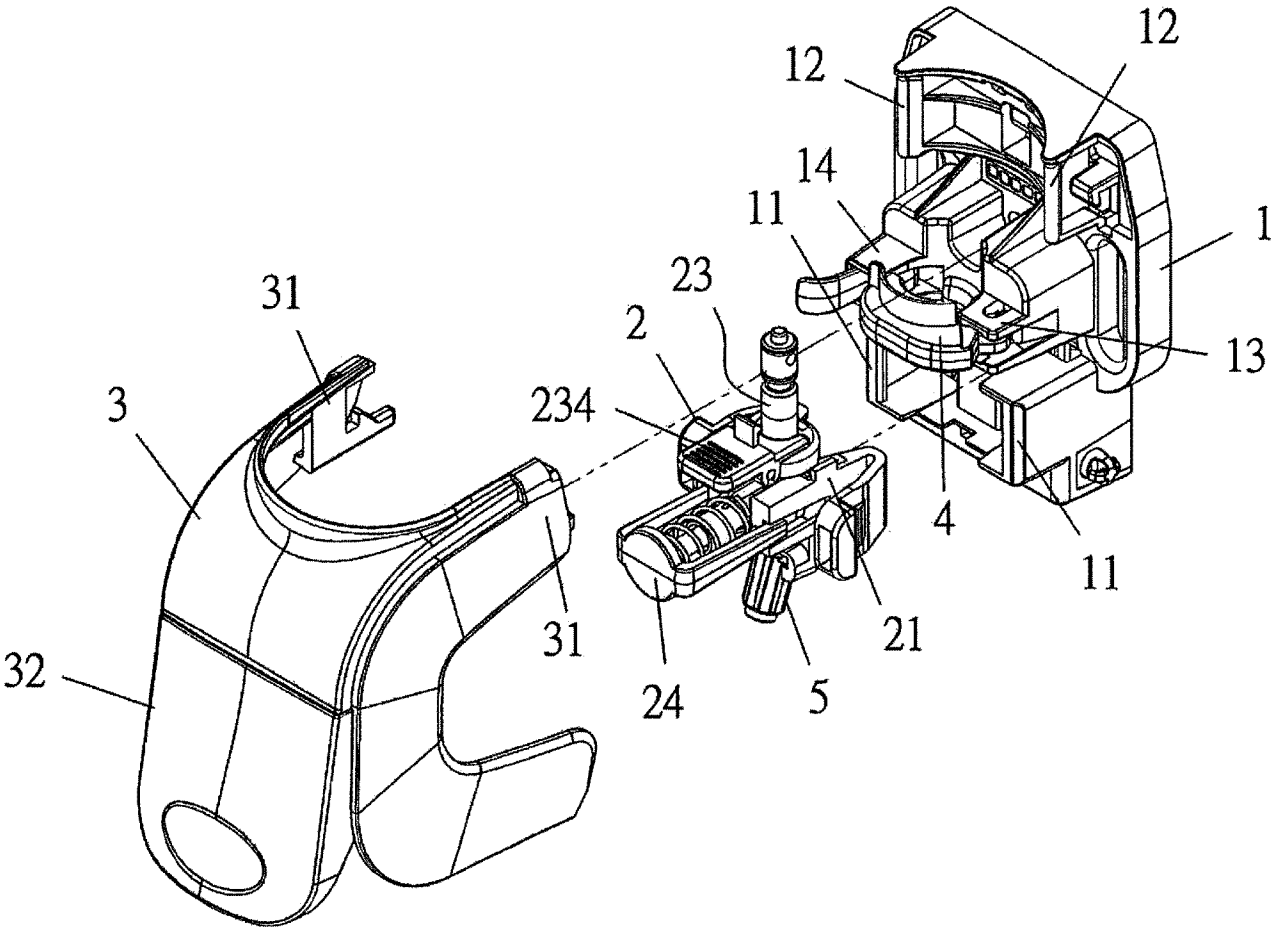
FIG. 1 is a perspective diagram showing the major components of a detergent dispensing device according to an embodiment of the present invention.
Figure 2:
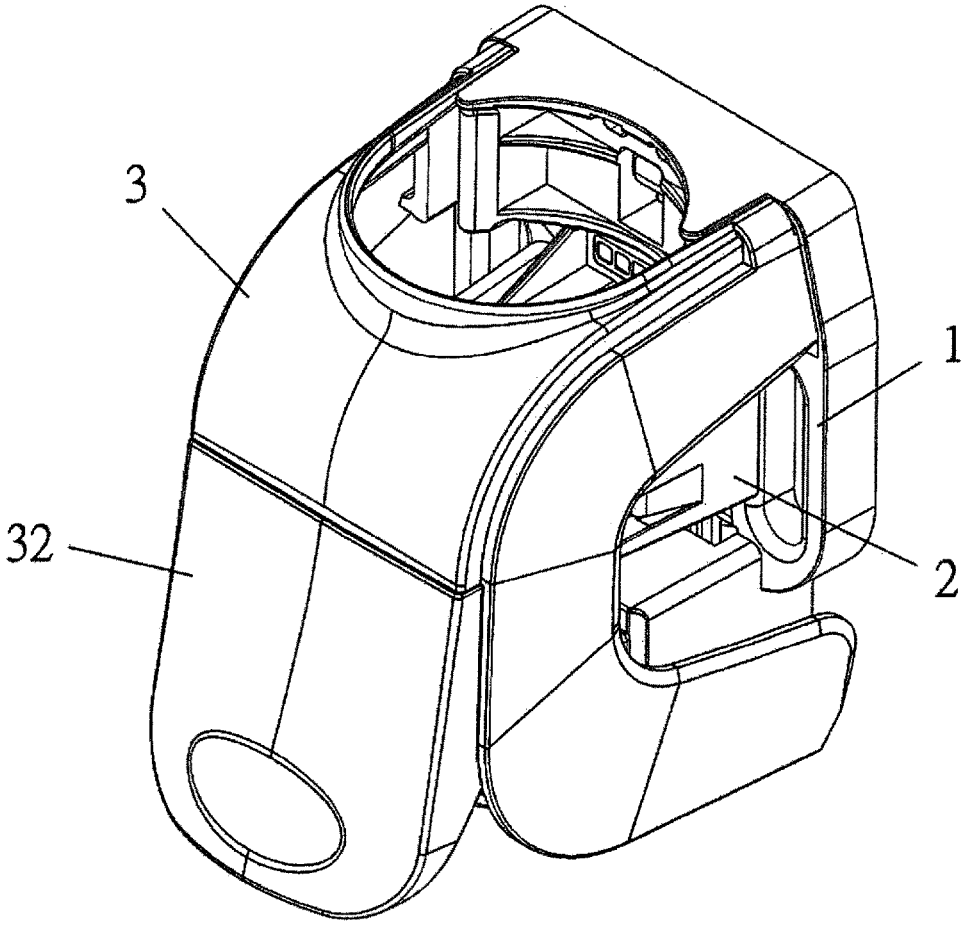
FIG. 2 is another perspective diagram showing the detergent dispensing device of FIG. 1 after its assembly.
Figure 3:
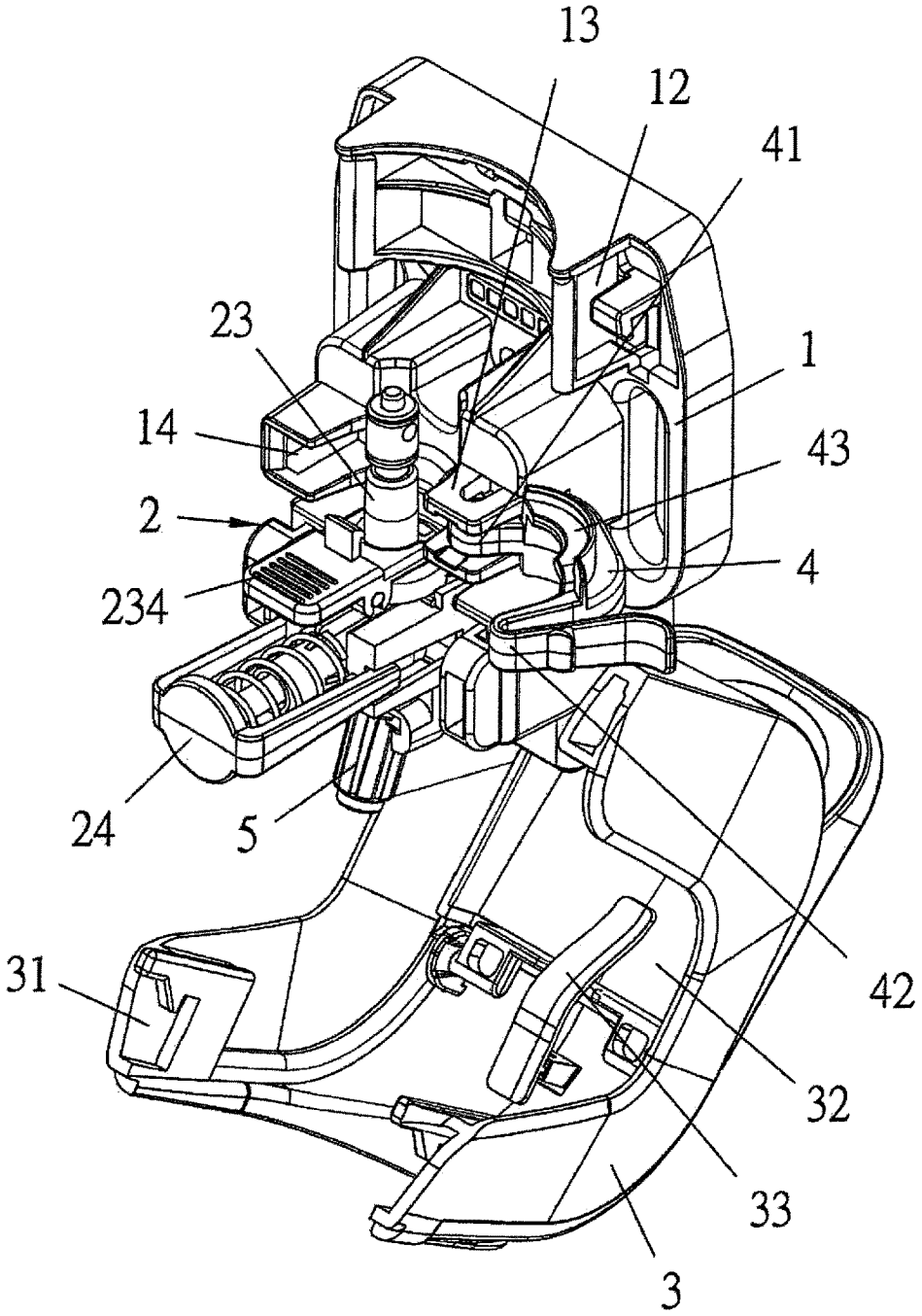
FIG. 3 is another perspective diagram showing the detergent dispensing device of FIG. 1 with a cap lifted open.
Figure 4:
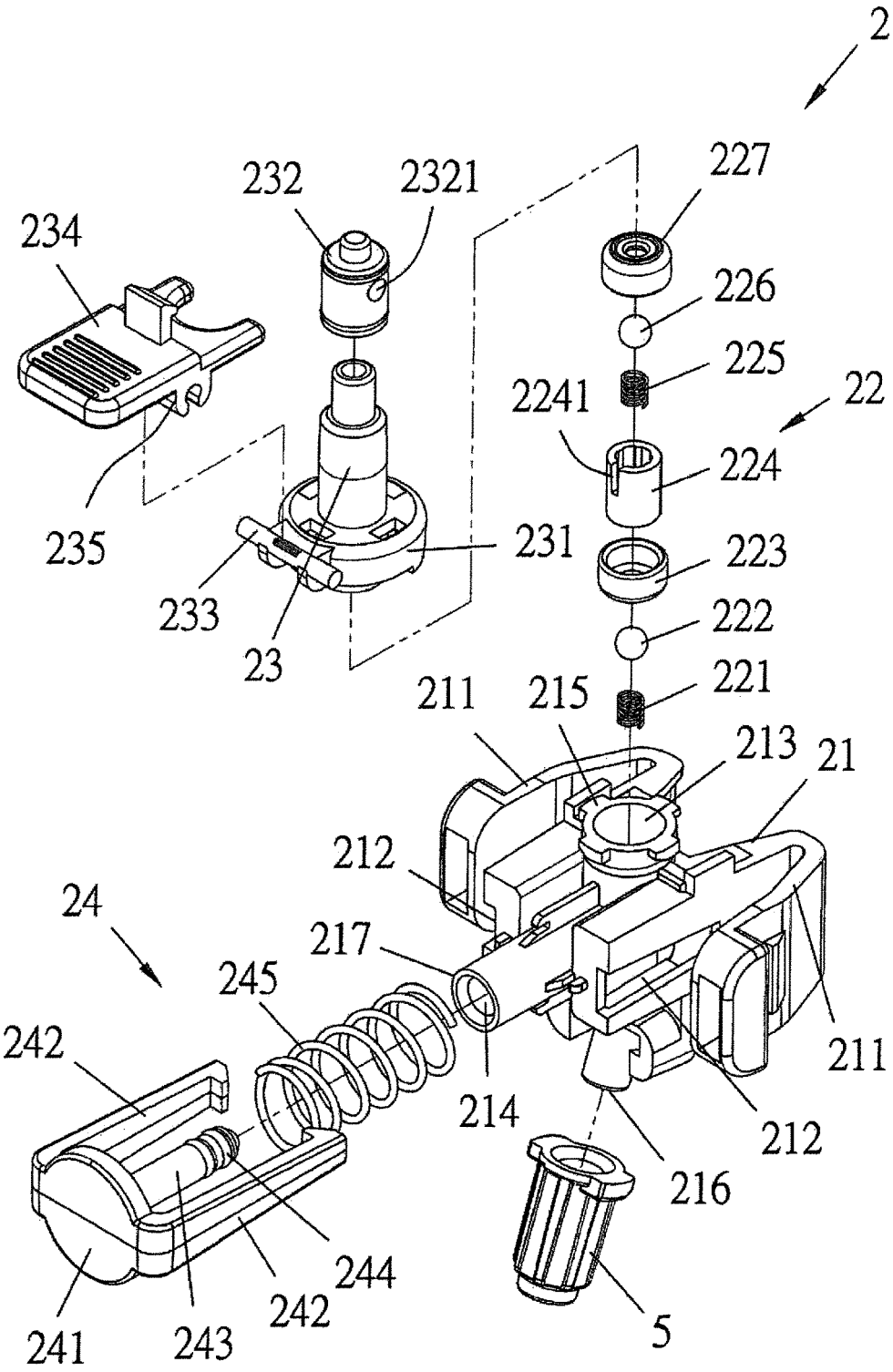
FIG. 4 is a perspective break down diagram showing the components of an extrusion assembly of the detergent dispensing device of FIG. 1.
Figure 5:
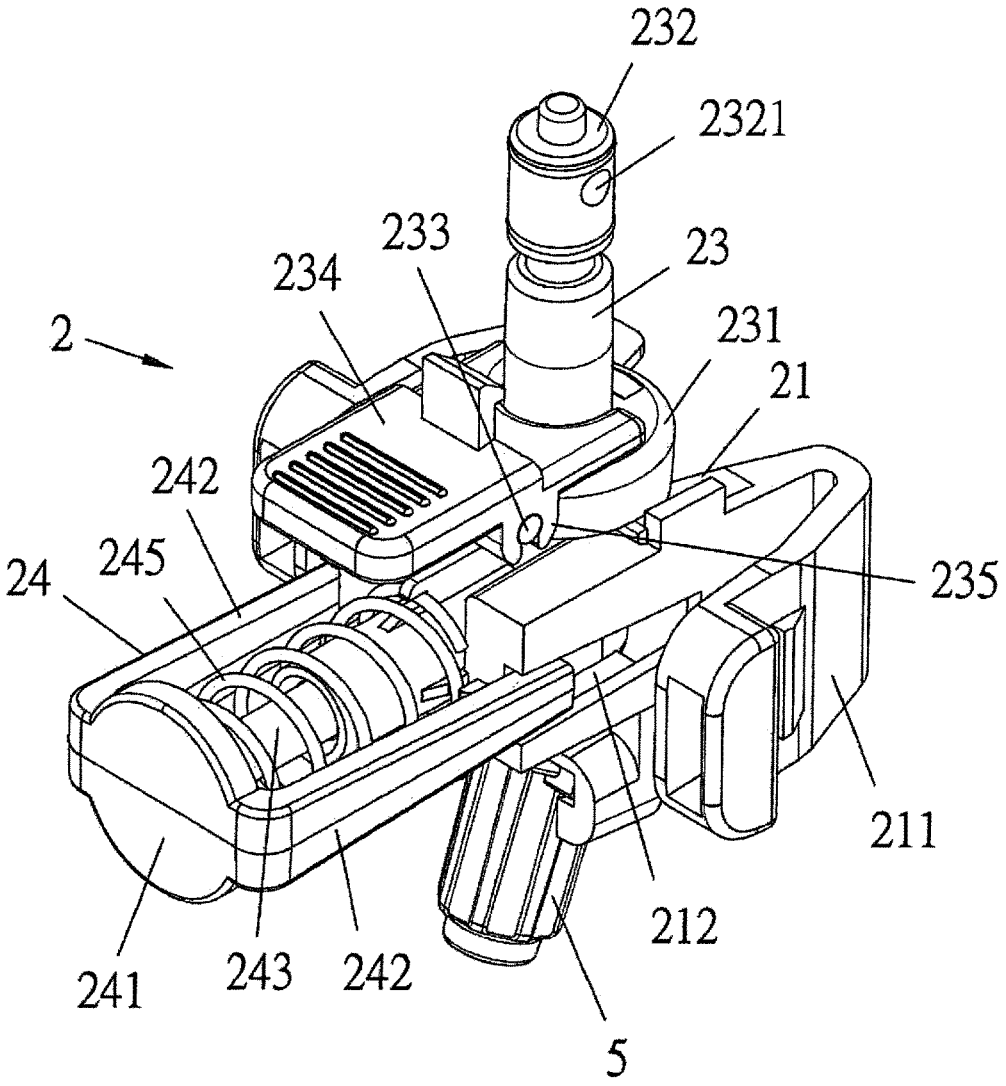
FIG. 5 is another perspective diagram showing the extrusion assembly of FIG. 4 after its assembly.

The following descriptions are exemplary embodiments only and are not intended to limit the scope, applicability or configuration of the invention in any way. Rather, the following description provides a convenient illustration for implementing exemplary embodiments of the invention. Various changes to the described embodiments may be made in the function and arrangement of the elements described without departing from the scope of the invention as set forth in the appended claims.

As shown in FIGS. 1 to 8, a detergent dispensing device according to an embodiment of the present invention includes a base 1, an extrusion assembly 2, a cap 3, and a U-shaped locking member 4.

The base 1 is for attaching the detergent dispensing device to a surface such as a wall. A front side of the base 1 is configured with a pair of opposing first fastening elements 11 to a lower section and a pair of second fastening elements 12 to an upper section of the base 1. A holder element 13 and a third fastening element 14 are positioned side by side between the first and second fastening elements 11 and 12.

The extrusion assembly 2 is joined to the front side of the base 1, and includes a seat member 21, a volume control member 22, a connection member 23, and an engagement member 24.

The seat member 21 includes a pair of fourth fastening elements 211 for joining to the first fastening elements 11 of the base 1 so that the seat member 21 is integrated to the base 1. The seat member 21 further includes two parallel troughs 212 between the fourth fastening elements 211 extending towards a front direction. The seat member 21 also includes between the troughs 212 a first tube 213 and a second tube 214 joining the first tube 213 extending upward and forward, respectively. The first tube 213 has an open top end 215 and an open bottom end 216, and the second tube 214 has an open front end 217. The first tube 213 has a section 2131 between the top and bottom ends 215 and 216 having a smaller aperture. At where the first and second tubes 213 and 214 are joined together, a first through hole 2141 is provided so that the insides of the first and second tubes 213 and 214 are connected. A nozzle 5 is configured to the bottom end 216 of the first tube 213.

Figure 6:
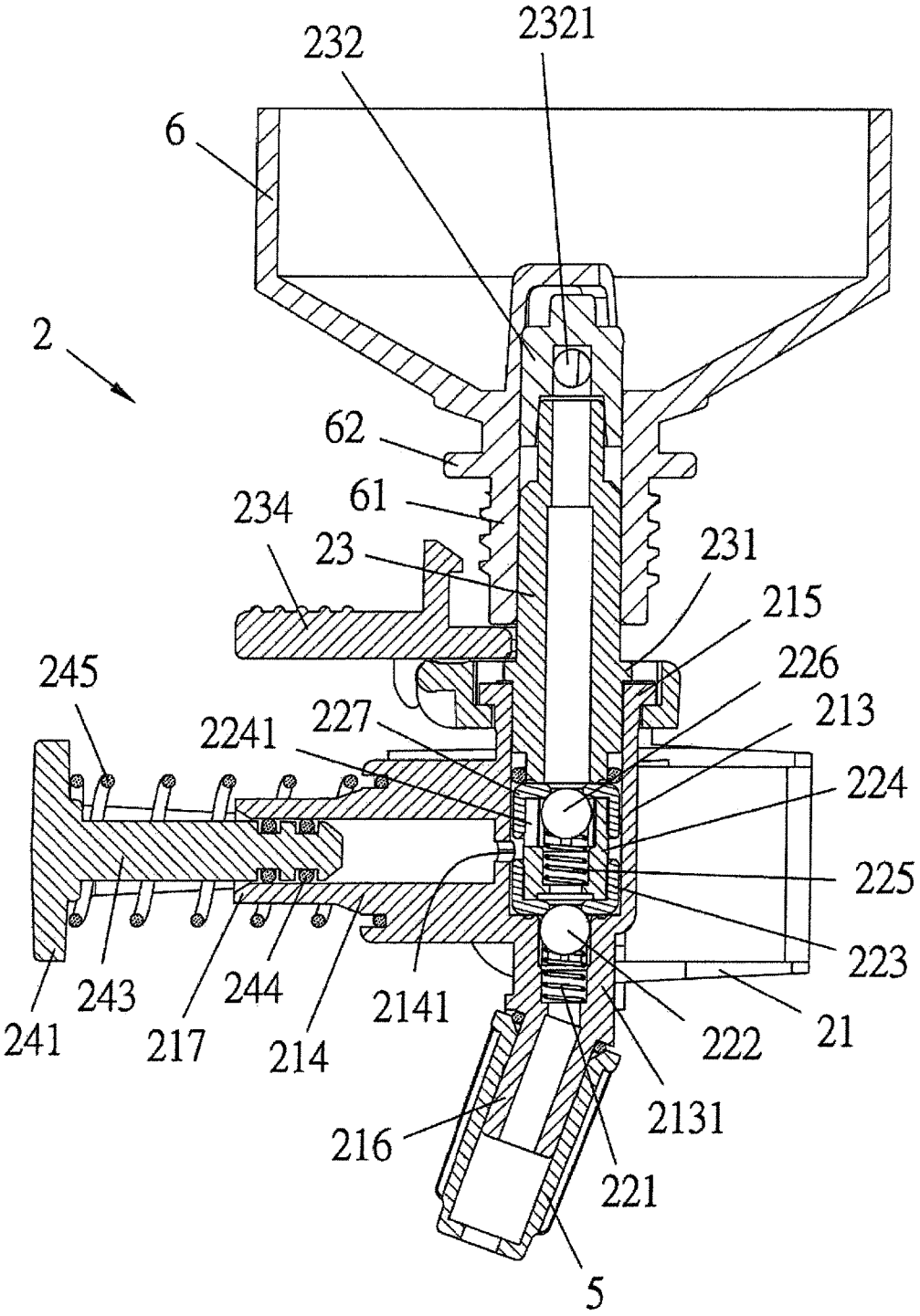
FIG. 6 is a schematic sectional diagram showing an application scenario of the extrusion assembly of FIG. 4.
Figure 7:
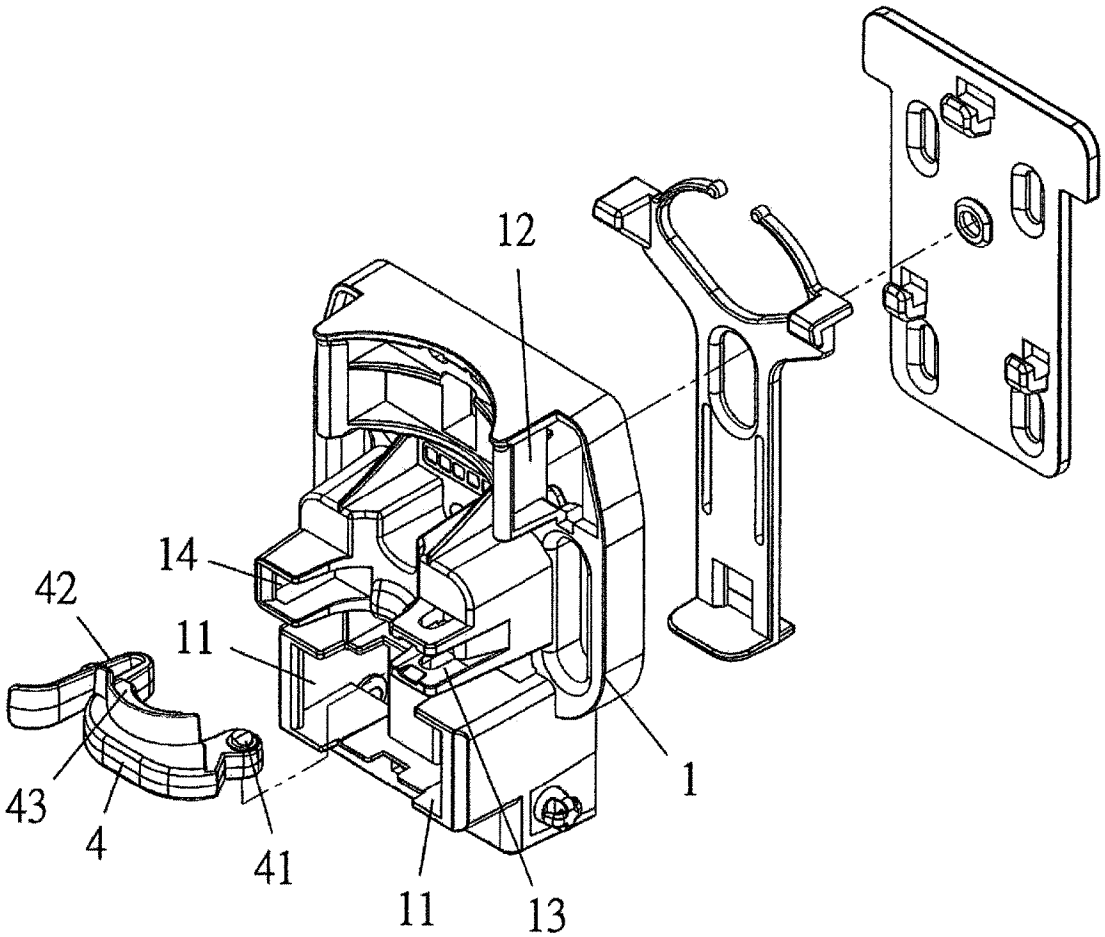
FIG. 7 is a perspective diagram showing the components of a base of the detergent dispensing device of FIG. 1.
Figure 8:
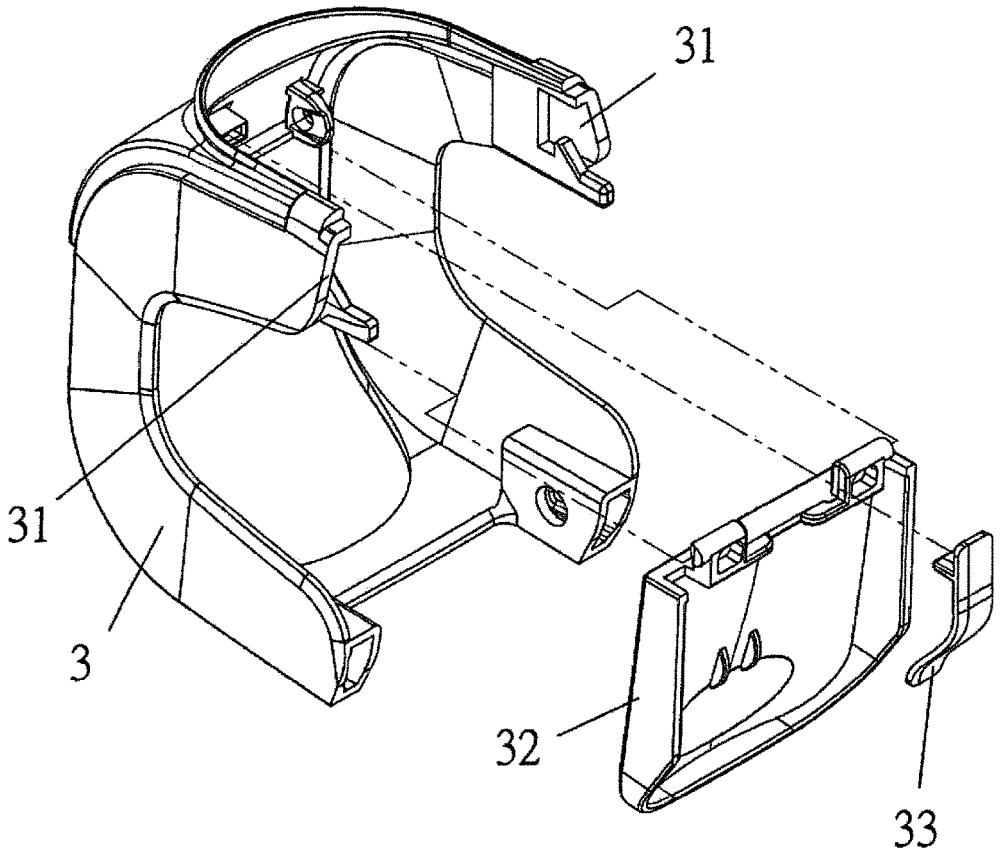
FIG. 8 is a perspective diagram showing the components of a cap of the detergent dispensing device of FIG. 1.

The volume control member 22 is configured inside the first tube 213, and includes a first spring 221, a first ball 222, a first cap 223, a hollow tube 224, a second spring 225, a second ball 226, and a second cap 227. The first spring 221, the first ball 222, the first cap 223, the hollow tube 224, and the second cap 227 are arranged sequentially from bottom to top within the first tube 213. The second spring 225 and the second ball 226 are positioned inside the hollow tube 224. As shown in FIG. 6, the first spring 221 and the first ball 222 are located within the narrower section 2131 of the first tube 213. The first cap 223 has an opening blocked by the first ball 222, and the second cap 227 also has an opening blocked by the second ball 226. The hollow tube 224 has a slit 2241 on the circumference adjacent to the second cap 227.

The connection member 23 is joined to the open top end 215 of the seat member 21 and connected to the first tube 213. The connection member 23 has a fifth fastening element 231 at a bottom end and a plug 232 at a top end. The fifth fastening element 231 is joined to the open top end 215. The plug 232 has a second through hole 2321 on a circumferential wall connecting the connection member 23. The connection member 23 further has a lateral rod 233 around a front bottom portion of the connection member 23, and a lever piece 234 with a clamp 235 on a bottom side of the lever piece 234 for rotatably clamping the lateral rod 233 so that the lever piece 234 may pivot upon the lateral rod 233 to be lifted up and down.

The engagement member 24 is joined to the second tube 214 of the seat member 21. The engagement member 24 has a button piece 241 on a front side with two opposing hooked arms 242 extending backward. The hooked arms 242 are received by and slidable back and forth along the troughs 212 of the seat member 21. A push rod 243 extends backward from a back side of the button piece 241 between the hooked arms 242 and is received by the second tube 214 through the open front end 217. A tip of the push rod 243 is configured with at least a plastic ring 244. A third spring 245 is configured between the engagement member 24 and the seat member 21, and is sleeved over the second tube 214 and threaded through by the push rod 243. Therefore the engagement member 24 may move resiliently back and forth relatively to the second tube 214.

The cap 3 is joined to and covers the front side of the base 1. The cap 3 has two backward extending sixth fastening elements 31 joined to the second fastening elements 12, respectively. The cap 3 further has a hinged front handle plate 32 with a depressing piece 33 on a back side of the handle plate 32. After the handle plate 32 is joined to the base 1, the handle plate 32 is positioned in front of the engagement member 24 and the depression of the handle plate 32 would engage the engagement member 24.

The U-shaped locking member 4 is joined to the front side of the base 1. The U-shaped locking member 4 has a pivot 41 to a lateral side and a seventh fastening element 42 to the other lateral side. The pivot 41 is hinged to the holder element 13 so that the locking member 4 may pivot on the pivot 41. The seventh fastening element 42 is detachably joined to the third fastening element 14. The locking member 4 has a blocking flange 43 extending toward the base 1.

Figure 9:
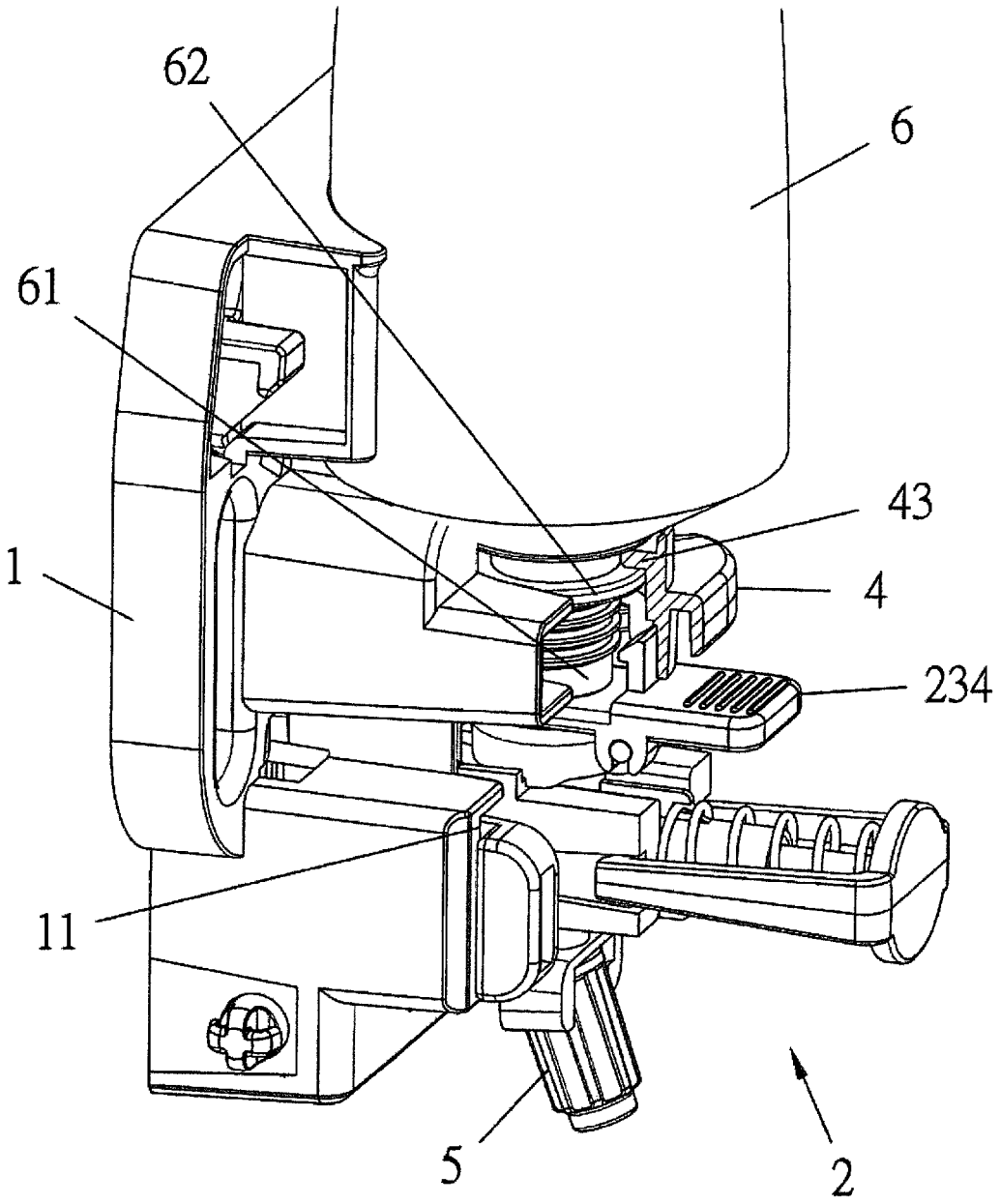
FIG. 9 is a schematic diagram showing an application scenario of the detergent dispensing device of FIG. 1.
Figure 10:
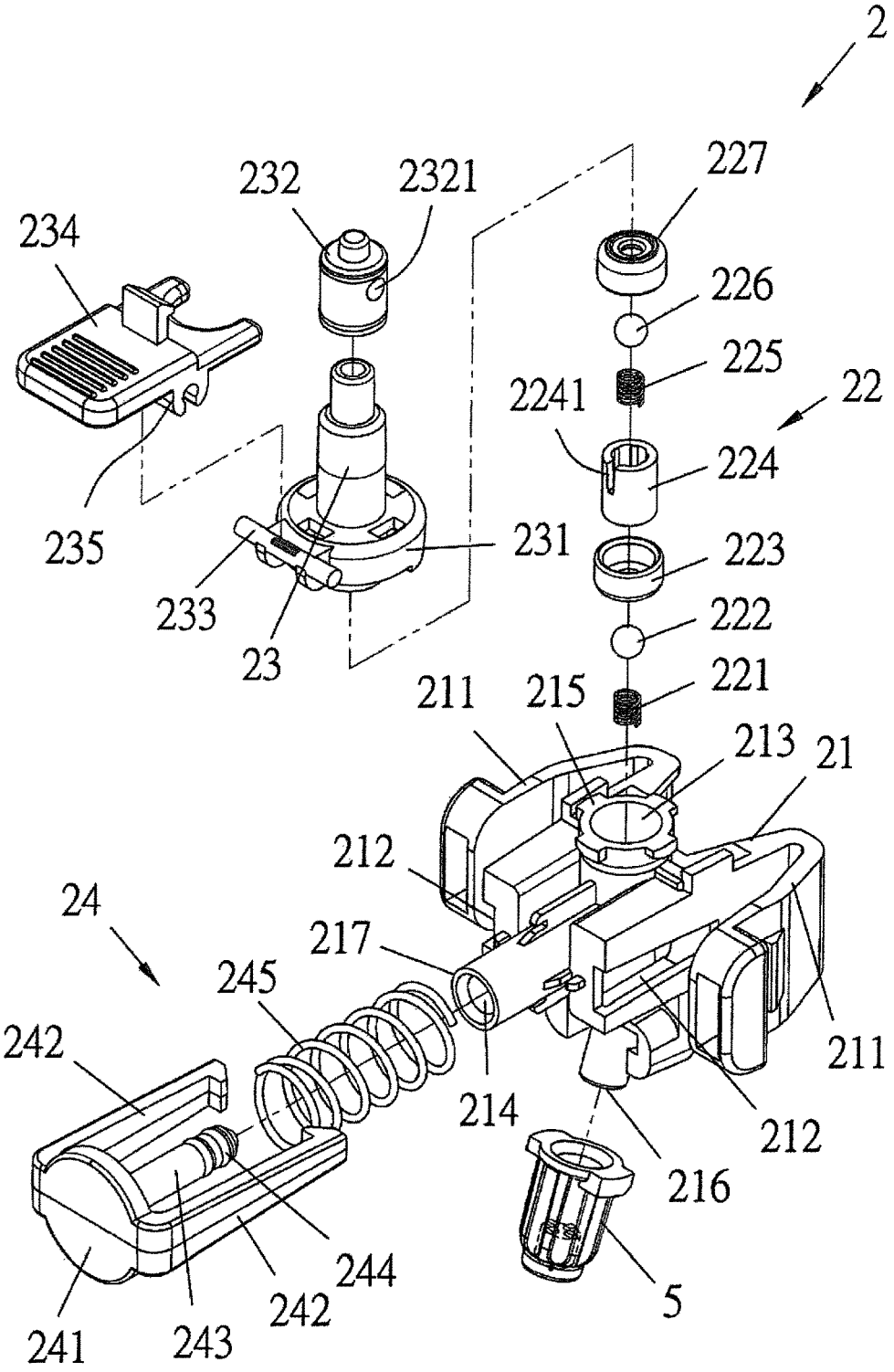
FIG. 10 is another perspective break down diagram showing the components of the extrusion assembly of the detergent dispensing device of FIG. 1.

To use the present embodiment, a bottle 6 of detergent with an outlet 61 surrounded by a ring flange 62 is mounted on the detergent dispensing device by turning the bottle 6 upside down and sleeving the outlet 61 onto the connection member 23. The outlet 61 would be located above the lever piece 234 as shown in FIG. 6. Then, by pressing the lever piece 234 downward, a back edge of the lever piece 234 would raise the bottle 6 away from the connection member 23. When the bottle 6 is mounted on connection member 23, the locking member 4 may wrap a front portion of the bottle 6 where the blocking flange 43 is above the ring flange 62 of the bottle 6, as shown in FIG. 9. Therefore, the bottle 6 is secured and prevented from being easily extracted.

In another scenario, the plug 232 may be positioned inside the outlet 61 first so as to prevent the detergent from leaking out of the bottle 6. When the bottle 6 is mounted on the detergent dispensing device, the connection member 23 pushes the plug 232 further into the bottle 6 and the detergent inside bottle 6 may flow into the connection member 23 through the second through hole 2321 and then into the first tube 213. When the engagement member 24 is engaged, the push rod 243 moves along and squeeze the air inside the second tube 241 towards the first tube 213. The first ball 222 is driven downward away from the opening of the first cap 223. The second ball 226 on the other hand blocks the opening of the second cap 227. The detergent therefore flows out of the bottom end 216 of the first tube 213. When the engagement member 24 is restored to its original position, the push rod 243 moves away from the first tube 213, creating a negative pressure in the second tube. The second ball 226 is drawn downward away from the opening of the second cap 227. The first ball 222 on the other hand blocks the opening of the first cap 223 so that a portion of the detergent flows between the first and second balls 222 and 226. Therefore, for each depression of the engagement member 24, a fixed amount of detergent is provided.

The connection member 23 of the extrusion assembly 2 may be fit into various types of bottles 6. Therefore the detergent dispensing device may be applied to all kinds of detergent bottles 6. There is no need to store the detergent into a specific type of storage bottle in advance, thereby enhancing the convenience of the detergent dispensing device.

While certain novel features of this invention have been shown and described and are pointed out in the annexed claim, it is not intended to be limited to the details above, since it will be understood that various omissions, modifications, substitutions and changes in the forms and details of the device illustrated and in its operation can be made by those skilled in the art without departing in any way from the claims of the present invention.

I claim:

1. An detergent dispensing device, comprising:

a base for attaching the detergent dispensing device to a surface having a pair of opposing first fastening elements on a front side of the base; and an extrusion assembly joined to a front side of the base comprising a seat member, a volume control member, a connection member, and an engagement member; wherein the seat member comprises a pair of second fastening elements for joining to the first fastening elements of the base, two parallel troughs between the second fastening elements extending towards a front direction, a first tube and a second tube joining the first tube extending upward and forward, respectively; the first tube has an open top end and an open bottom end; and the second tube has an open front end; the first tube has a narrower section between the top and bottom ends having a smaller aperture;

the volume control member is configured inside the first tube, and comprises a first spring, a first ball, a first cap, a hollow tube, a second spring, a second ball, and a second cap; the first spring, the first ball, the first cap, the hollow tube, and the second cap are arranged sequentially from bottom to top within the first tube; the second spring and the second ball are positioned inside the hollow tube; the first spring and the first ball are located within the narrower section of the first tube; the first cap has an opening blocked by the first ball; and the second cap has an opening blocked by the second ball;

the connection member is joined to the open top end of the seat member and connected to the first tube;

the engagement member is joined to the second tube of the seat member; the engagement member comprises a button piece on a front side with two opposing hooked arms extending backward; the hooked arms are received by and slidable back and forth along the troughs of the seat member; a push rod extends backward from a back side of the button piece between the hooked arms and is received by the second tube through the open front end; a third spring is configured between the engagement member and the seat member, and is sleeved over the second tube and threaded through by the push rod; the engagement member is moveable resiliently back and forth relatively to the second tube;

when the engagement member is engaged, the push rod moves along and squeeze the air inside the second tube towards the first tube, and the first ball is driven downward away from the opening of the first cap; and when the engagement member is restored resiliently to its original position, a negative pressure is created in the second tube, and the second ball is drawn downward away from the opening of the second cap.

2. The detergent dispensing device according to claim 1, wherein a first through hole is provided at where the first and second tubes are joined together.

3. The detergent dispensing device according to claim 1, wherein the connection member comprises a fifth fastening element at a bottom end and a plug at a top end; the fifth fastening element is joined to the open top end of the seat member; the plug has a second through hole on a circumferential wall connecting the connection member; the connection member further comprises a lateral rod around a front bottom portion of the connection member, and a lever piece with a clamp on a bottom side of the lever piece for rotatably clamping the lateral rod so that the lever piece pivots upon the lateral rod to be lifted up and down.

4. The detergent dispensing device according to claim 1, wherein the at least a plastic ring is configured on a tip of the push rod.

5. The detergent dispensing device according to claim 1, further comprising a cap is joined to and covers the front side of the base, wherein the cap has a pair of backward extending sixth fastening elements joined to the second fastening elements, respectively; the cap further has a hinged front handle plate; after the handle plate is joined to the base, the handle plate is positioned in front of the engagement member and the depression of the handle plate engages the engagement member.

6. The detergent dispensing device according to claim 5, wherein a depressing piece is configured on a back side of the handle plate.

7. The detergent dispensing device according to claim 1, further comprising a U-shaped locking member joined to the front side of the base, wherein the U-shaped locking member has a pivot to a lateral side and a seventh fastening element to the other lateral side; the locking member is hinged to the holder element through the pivot; the seventh fastening element is detachably joined to a third fastening element; and the locking member has a blocking flange extending toward the base.

* * * * *